United States Patent [19]

Gantin

[11] 4,121,497

[45] Oct. 24, 1978

[54] APPARATUS FOR TRIGGERING RAPID INDIVIDUAL FIRING

[75] Inventor: Robert Gantin, Douvaine, France

[73] Assignee: Werkzeugmaschinenfabrik Oerlikon-Bührle AG, Zürich, Switzerland

[21] Appl. No.: 825,839

[22] Filed: Aug. 18, 1977

[30] Foreign Application Priority Data

Oct. 27, 1976 [CH] Switzerland ..... 013524/76

[51] Int. Cl.[2] ..... F41D 11/02

[52] U.S. Cl. ..... 89/129 R

[58] Field of Search ..... 89/129 R, 130, 131

[56] References Cited

U.S. PATENT DOCUMENTS

| | | | |
|---|---|---|---|
| 1,741,534 | 12/1929 | Pfeiffer | 89/130 |
| 3,306,167 | 2/1967 | Ramseyer | 89/140 |
| 3,886,843 | 6/1975 | Hoffmann et al. | 89/136 |
| 4,063,487 | 12/1977 | Pier-Amory | 89/130 |

*Primary Examiner*—Stephen C. Bentley

*Attorney, Agent, or Firm*—Werner W. Kleeman

[57] ABSTRACT

An apparatus for triggering a rapid individual firing at an automatic, rearwardly movably mounted firing weapon, comprising a trigger rod by means of which the trigger of the firing weapon can be actuated by a handgrip. At the trigger rod there is arranged a toggle lever, at which there is hingedly connected a piston displaceable into two positions. Upon return movement of the weapon the piston is displaceable into one position and during forward movement of the weapon into the other position. In one position the toggle lever is extended and in the other position the toggle lever is collapsed or bent and the movement thereof can be controlled by an hydraulic dampening device.

4 Claims, 1 Drawing Figure

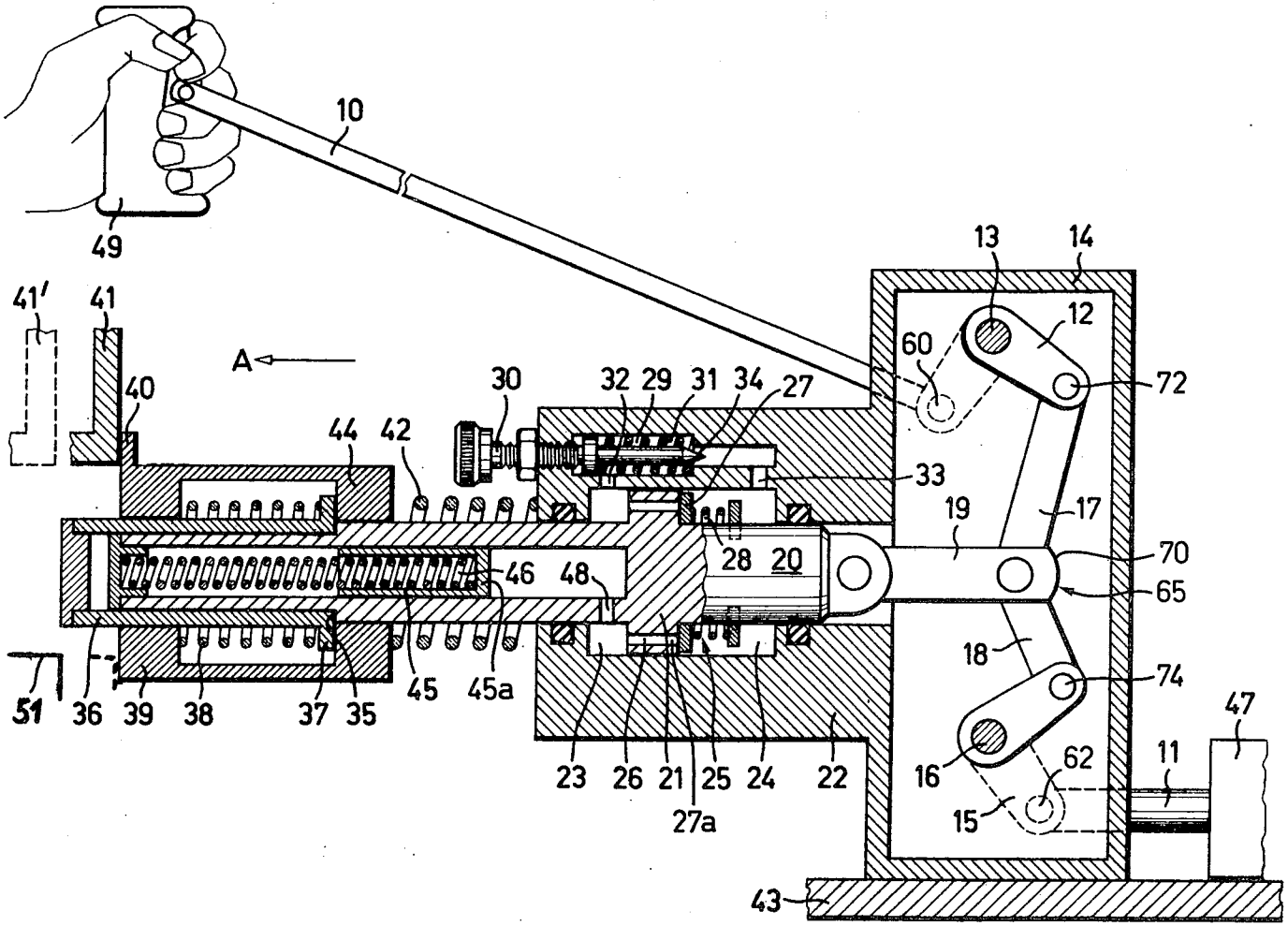
10
11
12
13
14
15
16
17
18
19
20
21
22
23
24
25
26
27
27a
28
29
30
31
32
33
34
35
36
37
38
39
40
41
41'
42
43
44
45
45a
46
47
48
49
51
60
62
65
70
72
74
A

APPARATUS FOR TRIGGERING RAPID INDIVIDUAL FIRING

BACKGROUND OF THE INVENTION

The present invention relates to a new and improved construction of apparatus for triggering a rapid individual firing at an automatic, rearwardly movable mounted firing weapon having a trigger rod by means of which the trigger of the firing weapon can be actuated by a handgrip or a handle.

Trigger devices for automatic firing weapons are already known to the art. In Swiss Pat. No. 419,907 there is described a trigger device which can be actuated by a handgrip through the agency of a trigger rod. The device especially serves the purpose, in the case of large firing weapons or guns to maintain the force for actuating the trigger so small that the weapon can be easily actuated with a finger. With this trigger device it is, however, only possible to trigger series or rapid firing at a large cadence, for instance 570 to 1000 rounds per minute or individual firing. When working in the individual firing mode the trigger must be actuated with the finger for each shot or round which is fired, and there can only be reached firing cadences of a maximum of one round per second. In Swiss Pat. No. 565,360 there is described a pneumatic device for firing an automatic firing weapon, by means of which there can be selectively triggered rapid or series firing, limited rapid or series firing, individual firing and rapid individual firing, and under the term series or rapid firing there is again to be understood a firing mode of large cadence, as mentioned between 570 to 1000 rounds per minute. As to limited series firing there is to be understood a timewise limited firing, that is to say, the firing operation is automatically interrupted in accordance with an adjustable time. In the case of individual firing the trigger must be actuated to fire each shot around and in the case of rapid individual firing there is to be understood a firing mode of appreciably smaller cadence, for instance 30 to 400 shots or rounds per minute, with the trigger having only to be actuated once. There are provided pneumatically adjustable elements, by means of which there can be adjusted this smaller cadence. The drawback of such pneumatic device resides, however, in the fact that there is required a compressed air container as well as a number of complicated pneumatic control devices, which become inoperative when the compressed air container is depleted.

In Swiss Pat. No. 569,249 there is described an apparatus for the selective triggering of rapid or series firing or rapid individual firing, which however are incorporated into the weapon itself. In the case of firing weapons which do not possess such apparatus, it is usually not possible for reasons of space considerations to subsequently incorporate such apparatus into the firing weapon. Additionally, there are not provided means for adjusting the cadence of the rapid individual firing.

SUMMARY OF THE INVENTION

Hence, it is a primary object of the present invention to provide a new and improved construction of apparatus for triggering a rapid individual firing in a manner not associated with the aforementioned drawbacks of the prior art proposals.

Another and more specific object of the present invention aims at the provision of a trigger apparatus which can be subsequently incorporated into an existing firing weapon or gun, and by means of which it is possible to adjust the cadence for rapid individual firing, for instance to 30 to 400 rounds per minute.

Still a further significant object of the present invention is to avoid the use of an additional compressed air source in an apparatus for triggering rapid individual firing.

Now in order to implement these and still further objects of the invention, which will become more readily apparent as the descripion proceeds, the apparatus of the present development is manifested by the features that at the trigger rod there is arranged a toggle lever at which there is articulated a piston which can be displaced into two positions. Upon return of the firing weapon the piston can be shifted into the one position and upon forward movement of the firing weapon it can be shifted into the other position. In the one position the toggle lever is extended and in the other position the toggle lever is collapsed and its movement can be controlled by a hydraulic dampening device.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE illustrates, partially in sectional view, an exemplary embodiment of apparatus for triggering rapid individual firing and constructed according to the teachings of the present invention.

DETAILED DESCRIPTION OF THE PREFERRED EMBODIMENTS

Describing now the drawing, it will be seen that the apparatus for producing rapid individual firing at a firing weapon or gun comprises a trigger rod embodying a first rod 10 equipped with a handle or handgrip 49 which can be actuated by the gunner for firing shots or rounds. The trigger rod furthermore possesses a second rod 11 which is connected with the trigger device 47 of the not particularly illustrated firing weapon.

The first rod 10 is hingedly connected by means of the hinge pin 60 or equivalent structure with a first angle lever 12 which is rotatable about a first shaft 13 attached in a housing 14.

The second rod 11 is hingedly connected or articulated with a second angle lever 15, at the pivot pin 62, this angle lever 15 being rotatable about a second shaft 16 which likewise is secured in the housing 14.

Both of the angle levers 12 and 15 are interconnected with one another by means of a toggle lever system or toggle lever, generally designated by reference character 65. This toggle lever 65 comprises a longer lever or lever member 17 and a shorter lever or lever member 18. Both of the lever members 17 and 18 are connected with one another at their confronting ends, as generally indicated by reference character 70, and furthermore, the longer lever 17 is connected by the pivot pin 72 with the first angle lever 12 and the shorter lever 18 is connected by means of the pivot pin 74 at the second angle lever 15.

A piston rod 20 is hingedly connected by means of a bracket 19 at the connection location of both levers 17 and 18. At the piston rod 20 there is attached a piston 21. This piston 21 is displaceably arranged in a cylinder 22 which is secured to the aforementioned housing 14.

By means of the piston 21 the cylinder compartment is subdivided into two chambers 23 and 24.

The piston 21 possesses a number of check or nonreturn valves 25 which enable the liquid to flow out of the chamber 23 into the chamber 24 but not in the reverse manner. These check valves 25 are formed by bores 26 which can be closed by a ring 27. This ring 27 is pressed by a spring 28 against the mouths 27*a* of the bores 26.

Both of the chambers 23 and 24 are connected with one another by an adjustable throttle means. This throttle means comprises a throttle chamber 29 into which protrudes a throttle pin 34 which can be adjusted against the force of a spring 31 by turning the adjustment screw 30. The throttle chamber 29 is connected by a first bore 32 with the chamber 23 and a second bore 33 with the chamber 24. The tip of the throttle pin 34 is capable of controlling the flow through the bore 33, depending upon the depth of penetration of the throttle pin 34 into the throttle chamber 29 by turning the adjustment screw 30.

The piston rod 20 is provided with a shoulder 35 at a part thereof located at the left side of the piston 21. Bearing against the shoulder 35 of the piston rod 20 is a flange 37 of a first sleeve member or sleeve 36. A spring 38 bears at one end at the flange 37 and at the other end at a second sleeve 39 which is displaceably mounted at its right flange 44 upon the piston rod 20 and at its left end upon the first sleeve 36. The spring 38 thus strives to press the first sleeve 36, which is fixedly connected with the pistol rod 20, against the shoulder 35 of such piston rod 20. The second sleeve 39 possesses a stop 40 which bears against the breechblock housing 41 of the not further shown firing weapon. A spring 42 which bears at one end at the cylinder 22 and at the other end at the right end of the sleeve 39, strives to press the sleeve 39 together with its stop or impact member 40 against the breechblock housing 41 of the firing weapon.

The housing 14 and the cylinder 22 are stationarily mounted in the cradle or mount 43 of the firing weapon, where the breechblock housing 41 during the return movement of the weapon towards the left, i.e. in the direction of the arrow A, can be displaced, and the spring 42 due to its relaxation moves the sleeve 39 and via the flange 37 the sleeve 36 and the piston rod 20 towards the left. During the forward movement of the weapon the breechblock housing 41 shifts toward the right, i.e. opposite to the direction of the arrow A, and the spring 42 is tensioned. The left end or terminal position of the breechblock housing 41 which is reached upon the return movement of the weapon has been illustrated with broken lines and generally designated by reference character 41', and the right terminal or end position of the breechblock housing 41 which is reached upon forward movement of the weapon has been shown with full lines.

Prior to firing the weapon or gun the breechblock housing 41 is located in its starting position which has been illustrated in full lines. In this position of the breechblock housing the first sleeve 36 bears with its flange 37, under the action of the spring 38, at a flange 44 of the second sleeve 39. As a result, there is thus fixed the position of the piston rod 20 which is attached to this sleeve 36.

Displaceably mounted within the piston rod 20 is a sleeve-like piston 45 which is loaded by a spring 46 which, in turn, bears at one end at the floor or base 45*a* of the sleeve-like piston 45 and at the other end bears at the left end of the piston rod 20. This sleeve-like piston 45 strives to place under pressure the reserve liquid contained internally of the piston rod 20 and to press such through a transverse bore 48 into the pressureless chamber 23 of the cylinder 22, in order to replace any possible leakage losses which could have resulted through the seals of the cylinder 22. The entire apparatus furthermore contains a cradle-fixed stop or impact member 51 which during rapid individual firing must be located in the rear position shown with full lines.

The mode of operation of the described apparatus is as follows:

The described apparatus for rapid individual firing can be used with a weapon where there can be triggered both individual firing as well as also series or rapid firing.

Under series or rapid firing there is to be understood a firing mode having a cadence of 570 to 1000 rounds per minute, depending upon the nature of the firing weapon or gun. Individual firing means that the gun operator, after firing each shot or round, must release the trigger and again reactuate such. Under rapid individual firing there is to be understood a firing mode having a cadence between 30 to 400 rounds or shots per minute, independent of the nature of the firing weapon. This cadence, as will be described more fully hereinafter, can be randomly adjusted with the aid of the inventive apparatus for rapid individual firing.

The trigger device 47 of the employed firing weapon is switched in conventional manner to individual firing and the stop or impact member 51 is brought into the retracted position illustrated in full lines. In the event that the described apparatus is not connected to the firing weapon, then for each shot it is necessary to actuate the trigger device 47 by means of the rod 11, i.e. when the rod 11 has been drawn once towards the left, only one shot or round can be fired, independent of the time during which the rod 11 is retained in its left end or terminal position. To fire a further shot the rod 11 must be initially first returned back into its starting position by a return or restoring spring of the trigger device 47. Therefore it is not possible to manually fire more than about 50 to 60 shots or rounds per minute. In the event that there is desired a cadence which is smaller than the rapid or series firing of about 570 to 1000 shots per minute and greater than the cadence which is possible during manual actuation, then there is perferably employed the described device for rapid individual firing. This device also renders it possible to relieve the gunner from a rapid actuation of the handgrip.

Upon actuation of the handgrip 49 and by means of the rod 10 the angle lever 12 is rocked in the clockwise direction and by means of the levers 17 and 18 the angle lever 15 is also rocked in clockwise direction and the rod 11 is shifted into its left terminal position. If the gunner desires to trigger rapid individual firing, then he or she will not release the handgrip 49 for such length of time as the individual firing mode should prevail.

Upon triggering the first shot the breechblock housing 41 is moved by the recoil in the direction of the arrow A towards the left into the position 41' and the second sleeve 39 is likewise shifted towards the left by the spring 42, since the housing 14 which is secured to the cradle 43 together with the cylinder 22 undertakes the return movement. The stop 51 does not hinder the displacement of the second sleeve 39 in its retracted position.

Due to the displacement of the second sleeve or sleeve member 39 towards the left, the first sleeve or sleeve member 36 and the piston rod 20 are also shifted towards the left, since the flange 37 of the first sleeve 36 is supported upon the flange 44 of the second sleeve 39. Due to this displacement the toggle lever system or toggle levers 17 and 18 bows or deflects towards the left and the lever 11 moves towards the right back into its starting position. The displacement of the piston rod 20 and the piston 21 ensures that the liquid can flow out of the chamber 23 through the check valve 25 into the chamber 24, and the spring 28 of the check valve 25 is very weak and the liquid can flow practically without hindrance through the bores 26. The path of movement of the piston rod 20 towards the left is defined by the spacing between the piston 21 and the left flange of the cylinder 22, and generally the breechblock housing moves further into the illustrated position 41'.

During the subsequent forward movement of the breechblock housing 41 the second sleeve 39 is shifted towards the right by the stop 40 of the weapon housing 41 and compresses the spring 42. Consequently, the spring 38 is also tensioned and by means of the flange 37 and the shoulder 35 displaces the piston rod 20 towards the right. This displacement of the piston rod 20 towards the right brings about that the toggle levers 17 and 18 will be extended, the angle lever 15 will be rotated in the clockwise direction, the rod 11 will be shifted towards the left and a second shot will be triggered.

During this displacement of the piston rod 20 together with the piston 21 towards the right, the liquid must however be forced out of the chamber 24 into the chamber 23. The check valve 25 does not permit such throughflow. The liquid must therefore flow through the bore 33, throttle chamber 29 and bore 32 into the chamber 23. This flow can now be altered with the aid of the throttle pin 30, and triggering of the second shot can be delayed or accelerated. In this manner it is possible to adjust the cadence in a range of 30 to 400 shots per minute.

The weapon will fire a further shot during each forward movement for such length of time as the handgrip 49 is actuated. The rapid individual firing is thus interrupted only upon release of the handgrip 49.

If only a single shot should be fired with the weapon, then the stop 51 is shifted into the broken-line illustrated position and the trigger device 47 is switched-over to the single or individual firing mode. During the return movement of the weapon in the direction of the arrow A there is not possible movement of the second sleeve 39 towards the left, and the next shot is no longer automatically fired.

If it is not desired to incorporate the apparatus for rapid individual firing into the weapon, then the rod 10 and 11 are replaced by a single rod which is then directly connected with the handgrip 49 and the trigger device 47.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. In an apparatus for triggering rapid individual firing at an automatic firing weapon mounted for return and forward movements and having a trigger rod means for actuating the trigger means of the firing weapon by a handgrip, the improvement which comprises:

toggle lever means arranged at the trigger rod means;

a piston displaceable into two positions;

means for hingedly connecting said piston with the toggle lever means;

said piston, upon return movement of the firing weapon, being displaceable into a first one of said two positions and during forward movement of the firing weapon being displaceable into the other one of said two positions;

said piston in one position extending said toggle lever means;

said piston in the other position collapsing said toggle lever means; and hydraulic dampening means for controlling the movement of said toggle lever means.

2. The improvement as defined in claim 1, further including:

a housing;

two angle levers pivotably mounted in said housing;

each of said angle levers possessing two respective arms;

the trigger rod means being hingedly connected with the handgrip;

one arm of the first angle lever being articulated with the trigger rod means;

one arm of the second angle lever being hingedly connected with a rod of the trigger rod means connected with the trigger means;

said toggle lever means including two interconnected lever members;

the other of both arms of the angle lever being connected with one another via the two interconnected lever members of the toggle lever means; and a piston rod supporting said piston articulated with the connection location of both lever members of the toggle lever means.

3. The improvement as defined in claim 2, wherein:

said piston rod has a shoulder;

a first sleeve having a flange;

a second sleeve having a first flange and a second flange;

said first sleeve bearing with its flange at one end at the shoulder of the piston rod and at the first flange of the second sleeve;

a first spring bearing at one end at the flange of the first sleeve and at the other end at the second flange of the second sleeve;

a second spring bearing at one end at the first flange of the second sleeve and at the other end at the housing;

the firing weapon which is mounted for return movement having stop means;

the second spring striving to urge the second sleeve against the stop means of said firing weapon;

the first spring striving to displace the piston rod together with the piston against the resistance of the hydraulic dampening means.

4. In an apparatus for triggering rapid individual firing at an automatic firing weapon mounted for return and forward movements and having a trigger rod means for actuating the trigger means of the firing weapon by a handgrip, the improvement which comprises:

toggle lever means arranged at the trigger rod means;

a piston displaceable into two positions;

means for hingedly connecting said piston with the toggle lever means;

said piston, upon return movement of the firing weapon, being displaceable into a first one of said two positions and during forward movement of the firing weapon being displaceable into a second one of said two positions;

said piston in said first one of said two positions extending said toggle lever means;

said piston in the second one of said two positions collapsing said toggle lever means; and hydraulic dampening means for controlling the movement of said toggle lever means.

* * * * *